US009650861B2

(12) United States Patent
Pedersen et al.

(10) Patent No.: US 9,650,861 B2
(45) Date of Patent: May 16, 2017

(54) BRIDGE PLUG TOOL

(75) Inventors: Dag Pedersen, Narvik (NO); Robin Lovslett, Narvik (NO); Tore Vedal, Bardu (NO)

(73) Assignee: Qinterra Technologies, Stavanger (NO)

( * ) Notice: Subject to any disclaimer, the term of this patent is extended or adjusted under 35 U.S.C. 154(b) by 803 days.

(21) Appl. No.: 14/111,385

(22) PCT Filed: Apr. 13, 2012

(86) PCT No.: PCT/EP2012/056786
§ 371 (c)(1),
(2), (4) Date: Mar. 25, 2014

(87) PCT Pub. No.: WO2012/140201
PCT Pub. Date: Oct. 18, 2012

(65) Prior Publication Data

US 2014/0196913 A1 Jul. 17, 2014

(30) Foreign Application Priority Data

Apr. 15, 2011 (GB) ..... 1106367.4

(51) Int. Cl.
*E21B 33/129* (2006.01)
*E21B 33/134* (2006.01)

(52) U.S. Cl.
CPC ..... *E21B 33/134* (2013.01); *E21B 33/1291* (2013.01); *E21B 33/1293* (2013.01)

(58) Field of Classification Search
None
See application file for complete search history.

(56) References Cited

U.S. PATENT DOCUMENTS 2,885,008 A * 5/1959 Hoffer ..... E21B 43/14 166/136
3,695,352 A 10/1972 McGill
(Continued)

FOREIGN PATENT DOCUMENTS

GB 1398038 6/1975
GB 2150958 A 7/1985
(Continued)

OTHER PUBLICATIONS

International Preliminary Report on Patentability for International Application No. PCT/EP2012/056786 dated Oct. 15, 2013 (7 pages).
(Continued)

*Primary Examiner* — Giovanna C Wright
(74) *Attorney, Agent, or Firm* — Finnegan, Henderson, Farabow, Garrett & Dunner, LLP

(57) ABSTRACT

A bridge plug tool for use in a well, comprising: a tool body; a mandrel (3) extending through the tool body; a setting sleeve (2) positioned on the tool body; a packer module (4,5,6) located below the setting sleeve, the packer module having an expanded position in which its outer surface is expanded radially with respect to the tool body and a contracted position in which its outer surface is substantially the same as that of the tool body; and an anchor module (9,10,11) located below the packer module, the anchoring module comprising anchor elements moveable between an expanded position in which the anchor elements extend radially from the tool body and a contracted position in which the anchor elements are substantially aligned with the surface of the tool body; wherein the mandrel extends through the sleeve, packer module and anchor module; the mandrel and setting sleeve are relatively moveable between an axially extended position and an axially contracted position; and wherein the mandrel and setting sleeve engage the
(Continued)

anchor module and packer module such that relative movement of the mandrel and setting sleeve between the axially extended and axially contracted positions correspondingly moves the anchor module and packer module between the respective contracted and expanded positions. The use of the sleeve and mandrel arrangement allows setting and release mechanisms to be protected from the external environment of the tool.

15 Claims, 7 Drawing Sheets

(56) References Cited

U.S. PATENT DOCUMENTS 3,812,911 A * 5/1974 Vann ..... E21B 23/02 166/135
4,359,090 A 11/1982 Luke
4,436,150 A * 3/1984 Barker ..... E21B 33/134 166/123
4,576,230 A * 3/1986 Tapp ..... E21B 33/1292 166/138
7,290,603 B2 11/2007 Hiorth et al.
2004/0244966 A1 12/2004 Zimmerman et al.
2008/0060821 A1 3/2008 Smith et al.
2010/0186970 A1 7/2010 Burnett et al.
2010/0288508 A1 11/2010 Turley et al.

FOREIGN PATENT DOCUMENTS

GB 2308138 A 6/1997
WO WO 92/17681 A2 10/1992

OTHER PUBLICATIONS

International Search Report for International Application No. PCT/EP2012/056786 dated Feb. 1, 2013 (5 pages).

* cited by examiner

BRIDGE PLUG TOOL

This application is a National Stage Entry of International Patent Application No. PCT/EP2012/056786, filed Apr. 13, 2012, which is incorporated herein by reference.

FIELD OF THE INVENTION

This invention relates to bridge plug tools and to methods of operating bridge plug tools. Such tools and methods find use in oil and gas wells or the like.

BACKGROUND

Bridge plugs can be installed in pressurized wells, such as hydrocarbon well, to seal off a portion of the well, or to provide a barrier preventing flow of hydrocarbons from the well, or to prevent flow of gas, oil or water between zones down hole. Bridge plugs are usually set using an external setting tool to generate an axial force in the tool, resulting in radial expansion of an anchoring mechanism and a packer element towards the tubular inner wall. When the axial force provided by the setting tool reaches a predetermined level, the setting tool is disconnected from the plug and pulled out of the well, while the plug remains fixed to the casing or tubing down hole. The packer seals differential pressure above and below the tool and the anchoring mechanism prevents movement of the plug during the differential pressure period. A retrievable bridge plug is usually retrieved by lowering a pulling tool into the well. By mechanical manipulation, the pulling tool is latched to a fishing neck at the top of the tool, the plug is released from the tubing or casing, and pulled out of the well.

One problem in the use of such tools is the risk of retrievable plugs getting stuck when trying to release the plugs out of hole after having been used in a period for sealing differential pressure down hole. Problems with retrieving bridge plugs can include:

a) Sand or debris entering into vital parts in the release system and thereby preventing proper functioning of the mechanical. Sand, and/or debris can land on top of the plug as a result of fluid flow during equalizing carrying particles from the reservoir, perforation operations in the well above the plug, pressure testing causing scale and particles to fall down, fracturing operations with sand, or other operations that can cause settling of solids over the plug.

b) Deformation of elastomer in the plug such as swelling or permanent set caused by chemical and/or temperature effects on the material.

c) Explosive decompression in the elastomer element causing damage and/or deformation of the elastomer element.

d) Gap corrosion of sleeves in the tool that may over time prevent the proper function of release mechanisms, or sand building up in the annulus between a setting sleeve and the tubing or casing inner diameter.

Patents describing retrievable bridge plugs include U.S. Pat. No. 4,359,090, US2004/00244966, US2010/0186970, US2010/0019426, US2008/0060821, US2010/0288508, U.S. Pat. No. 7,290,603.

Equalizing systems, allowing the pressure above and below the tool to equalize exist in several known down hole tools in the form of ball valves sliding sleeves, shear screws, etc. One such system includes a long internal tube connecting an equalizing piston, below the packer to the fishing neck and operates by moving the fishing neck down.

SUMMARY

One aspect of this invention comprises a bridge plug tool for use in a well, comprising: a tool body; a mandrel extending through the tool body; a setting sleeve positioned on the tool body; a packer module located below the setting sleeve, the packer module having an expanded position in which its outer surface is expanded radially with respect to the tool body and a contracted position in which its outer surface is substantially the same as that of the tool body; and an anchor module located blow the packer module, the anchoring module comprising anchor elements moveable between an expanded position in which the anchor elements extend radially from the tool body and a contracted position in which the anchor elements are substantially aligned with the surface of the tool body; wherein the mandrel extends through the sleeve, packer module and anchor module; the mandrel and setting sleeve are relatively moveable between an axially extended position and an axially contracted position; and wherein the mandrel and setting sleeve engage the anchor module and packer module such that relative movement of the mandrel and setting sleeve between the axially extended and axially contracted positions correspondingly moves the anchor module and packer module between the respective contracted and expanded positions. The use of the sleeve and mandrel arrangement allows setting and release mechanisms to be protected from the external environment of the tool.

The anchor elements can comprise a series of slips arranged around the tool body that in use engage the wall of the well when in the extended position to prevent further movement of the tool in the well. The anchor module can comprise actuators that are mounted on the tool body to be axially moveable relative thereto by means of the mandrel and setting sleeve, the actuators comprising inclined surfaces that engage corresponding surfaces on the slips and force them radially outwards when the mandrel and setting sleeve are contracted. The actuators can comprise upper and lower subs mounted above and below the slips and positioned around the tool body. The actuating mechanism can therefore be within the tool and protected from the external environment.

The packer module can comprise a packer and upper and lower packer supports, the packer supports being engaged with the mandrel and sleeve such that contraction of the mandrel and packer acts to expand the packer.

The tool can further comprise a locking mechanism for holding the setting sleeve and mandrel in the contracted position. The locking mechanism can comprise a ratchet sleeve which extends into and engages the setting sleeve, and locking dogs located within the ratchet sleeve which engage the mandrel. A release mechanism can also be provided for releasing the mandrel and sleeve from the contracted position. The release mechanism can comprise a release sleeve which extends within the ratchet sleeve and is axially moveable to allow the locking dogs to disengage from the mandrel. The provision of the various sleeves again protects the release mechanism from the external environment.

In one embodiment, the mandrel comprises a main part and an extension part connected by means of a threaded engagement, wherein the extension part engages the tool body such that rotation of the main part extends the extension part by the action of the thread so as to provide relative movement of the mandrel and the sleeve to the extended position.

The mandrel can provides a fluid flow path with an opening at the bottom of the tool body, the tool further comprising a connection at the top of the mandrel surrounded by a fishing neck above the setting sleeve, wherein the connection and the fishing neck each have one or more ports and are relatively moveable so that the ports can be brought into alignment to allow fluid communication though the mandrel to the exterior of the tool body above the packer module. The fishing neck can be axially or rotationally moveable to bring the through holes into alignment. In this manner, any pressure difference above and below the packer can be equalized while the packer is still engaged with the well wall. Additionally or alternatively, a portion of the wall of the tool body can be provided that can be broken to allow fluid communication between the interior and exterior of the tool body.

The invention also provides a method of operating the tool, comprising: positioning the tool in a well at a predetermined location with the mandrel and setting sleeve in the extended position and the anchor and packer modules in contracted positions; initially contracting the mandrel and setting sleeve to expand the anchor module to engage the wall of the well and anchor the tool in position; further contracting the mandrel and setting sleeve by movement of the setting sleeve over the mandrel to expand the packer module to seal against the wall of the well; and securing the mandrel and setting sleeve in the further contracted position.

The method can further comprise opening one or more ports above the packer to allow fluid communication through the tool across the packer so as to equalize any pressure difference. The opening of the one or more ports can be achieved by relative axial or rotational movement of a fishing neck and connection located at the top of the tool. Alternatively, or in addition, the opening of the one or more ports can be achieved by breaking or perforating a portion of the wall of the tool body.

The method can further comprise moving the setting sleeve and mandrel to the extended position to move the packer module and anchor module to their respective contracted positions to disengage the anchor module from the wall of the well and release the seal of the packer module against the wall of the well. In one embodiment, moving the setting sleeve and mandrel can comprises releasing the setting sleeve from the mandrel. Moving the setting sleeve and mandrel can additionally or alternatively comprise rotating the mandrel to operate a screw thread to extend a portion of the mandrel relative to the setting sleeve.

Further aspects of the invention will be apparent from the following description.

DETAILED DESCRIPTION

The invention provides a retrievable bridge plug for use in oil or gas wells, where sand and debris can be prevented from entering into the pressure equalizing and/or release system. Pulling a mandrel relative to a locking system can radially expand slips and a packer with a force sufficient for resisting the pressure difference across the packer element. Pushing a mandrel relative to the locking system, or elongation of the mandrel can result in contraction of the packer element and slips. The elastomeric packer can be provided with an extrusion barrier and the slips anchoring system enables the tool to be used in high pressure and high temperature applications (e.g. 10,000 psi and up to 200 degrees Celsius) and in well with high concentrations of $H_2S$ and $CO_2$ (e.g. 40% $H_2S$ and 20% $CO_2$). Such down hole conditions often require the use of sophisticated materials. Although such materials can withstand the chemical degradation, they also make milling operations a lot more complicated as the milling equipment can be rapidly worn down due to the machinability of the materials. However, it will be appreciated that this invention is not limited to such uses and can be used in any environment.

In embodiments of the tool according to the invention, equalization of differential pressure and release can be achieved by latching a pulling tool on to an external fishing neck by using a standard pulling tool. Equalization of the pressure across the plug can be achieved by downward movement of the pulling tool. Releasing the plug can be achieved by upward movement of the pulling tool. The structure of the tool prevents sand or debris can from falling into the equalizing system and the release mechanism.

In one embodiment primary release can be achieved by using straight upward pulling of a fishing neck after having completed pressure equalization. A backup equalizing method is to rotate the top connection of the mandrel in a predetermined direction by an external torque generating equalizing tool conveyed, for example, on slick line, coiled tubing or drill pipe.

A backup release system can also be provided. An external torque generating release tool, conveyed in a similar manner to the external equalizing tool, can provide the secondary release in cases where, for example, the fishing neck is prevented from upward movement. A rotation of the fishing neck relative to the mandrel (for example, in the opposite direction to that used for the backup equalization method described above) will cause the mandrel to be elongated by action of a screw thread, resulting in a radial contraction of packer element and slips. Should the primary and secondary release systems both be damaged, the tool can be configured such that a short milling operation is needed to release the plug, in the event of a plug stuck in hole.

Figure 1:
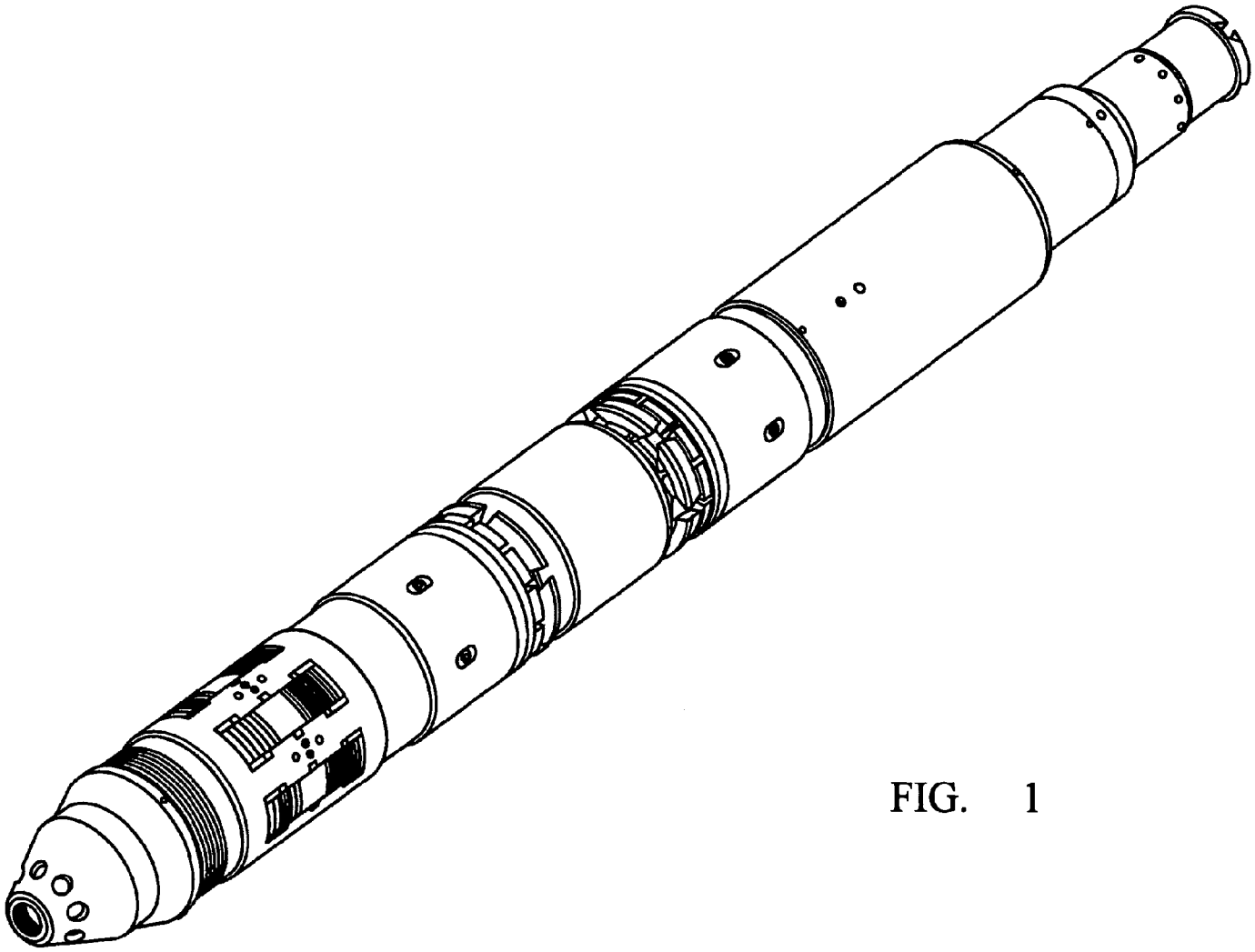
FIG. 1 shows a tool according to one embodiment of the invention.
Figure 2:
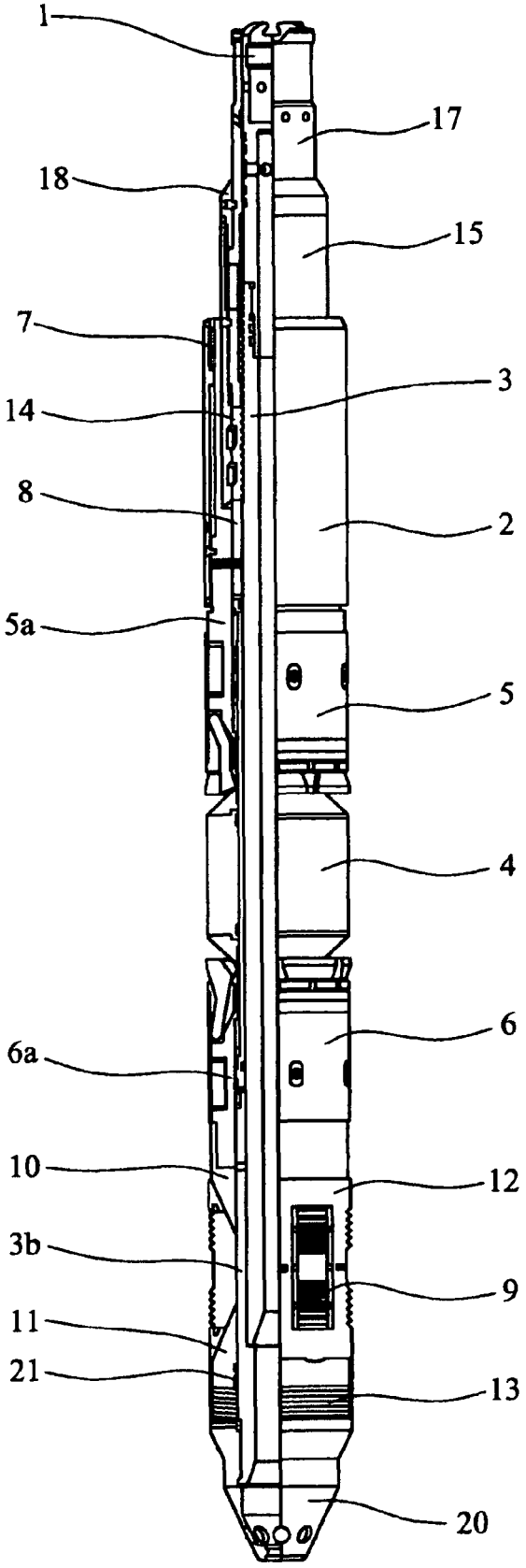
FIG. 2 shows a part-sectioned view of the tool of FIG. 1 as run into the well.

FIG. 1 shows a general view of the tool body of an embodiment of the invention, in the configuration in which the tool is run into the well. In this configuration, the tool has a substantially constant outer diameter to reduce the likelihood of hang-ups when running into the well and accidental setting before the tool reaches the desired location. FIG. 2 shows further internal detail of the tool in this configuration. A mandrel 3 extends through the interior of the tool body. A top connection 1 is provided at the upper end of the mandrel 3 and provides a latching mechanism for connection to a setting or release tool, and a series of ports extending through the side wall thereof (described in further detail below). A bull nose 20 is provided at the lower end of the mandrel 3 which provides fluid access to the interior of the mandrel from below the tool body.

A setting sleeve 2 is positioned at an upper part of the tool body around the mandrel 3. The mandrel 3 and setting sleeve 2 can be moved axially relative to each other as will be described below.

A packer module is located in the tool body below the setting sleeve 2 and comprises a packer 4 with upper and lower packer supports 5, 6 positioned around the tool body and located on either side of the packer 4. The packer supports 5, 6 can comprise an extrusion barrier of the type described in GB1018334.1. The setting sleeve 2 engages the upper packer support 5.

An anchor module is located below the packer module and comprises a series of slip elements 9 located around the tool body within an external tube 12 which has corresponding slots to allow the slip elements 9 to project radially outwardly from the tool body. Upper and lower slip subs 10, 11 are positioned around the tool body on either side of the slip elements 9. The slip subs 10, 11 have inclined surfaces which engage corresponding surfaces on the slip elements 9 such that when the slip subs 10, 11 are urged together, the slip elements 9 are caused to project through the holes in the sleeve 12. The upper slip sub 10 engages the lower packer support 6 and the lower end of the mandrel 3 is connected to the lower slip sub 11 by means of a tension ring 21.

Figure 3:
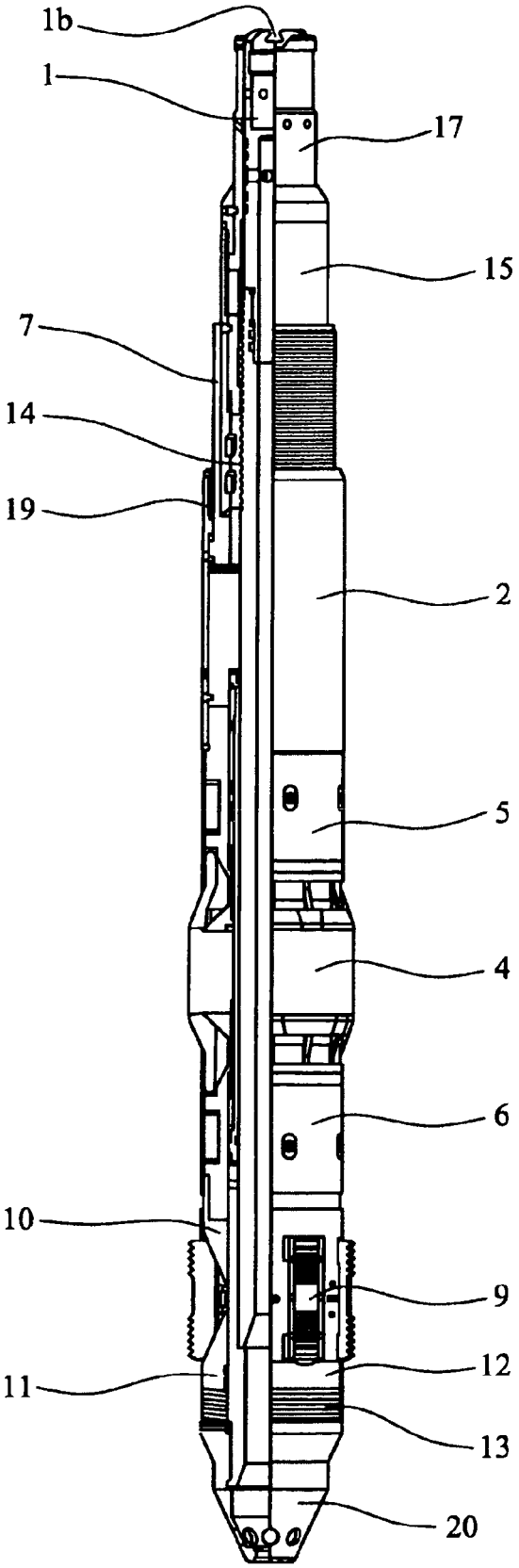
FIG. 3 shows the tool in its set configuration.
Figure 7:
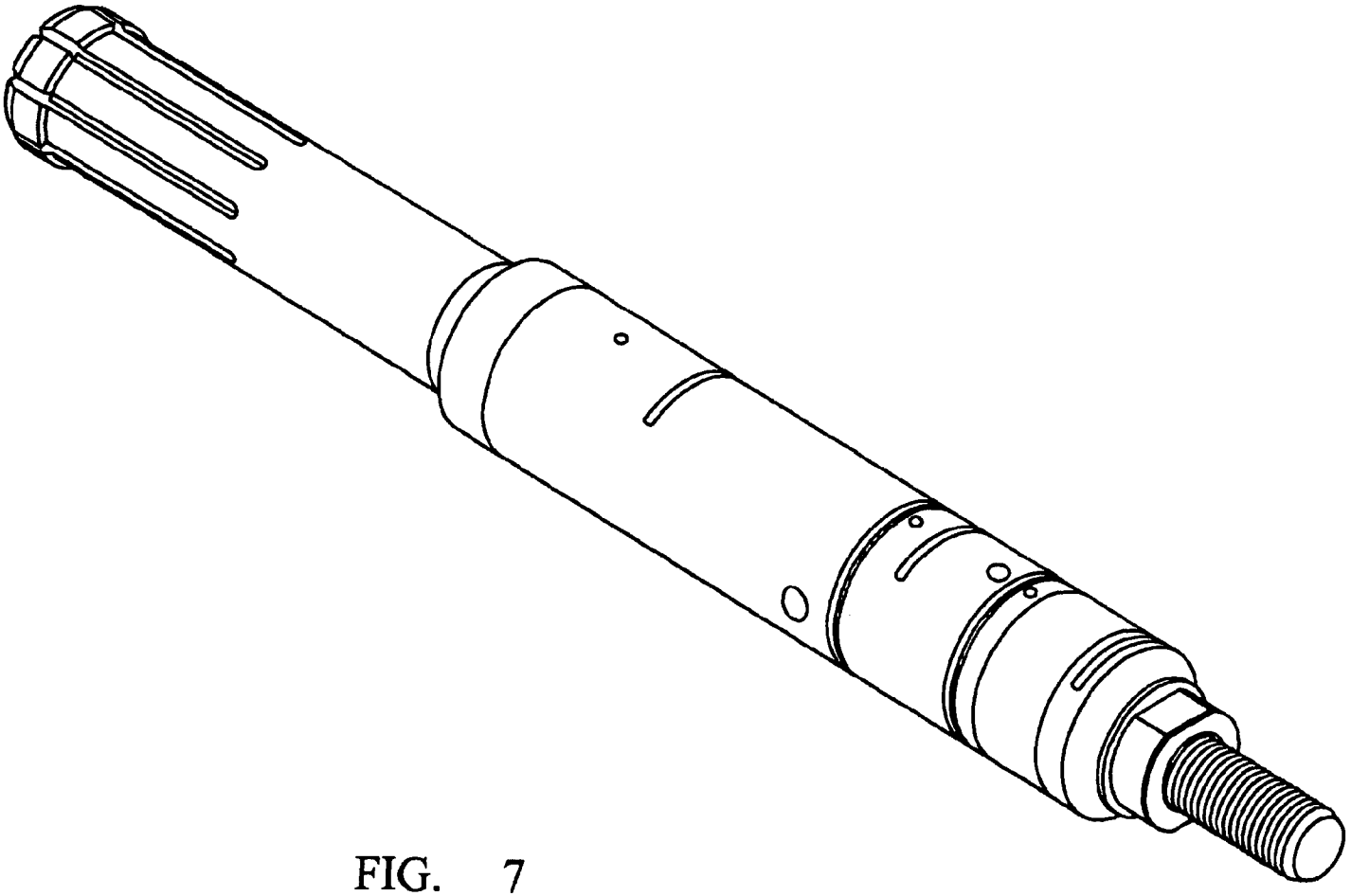
FIG. 7 shows a setting adapter for use with the tool.

Axial movement of the mandrel 3 and setting sleeve 2, such that the setting sleeve 2 is contracted towards the lower end of the mandrel 3 will have the effect of urging the upper and lower slips subs 10, 11 and upper and lower packer supports 5, 6 respectively towards each other, causing expansion of the slips 9 and packer 4 (see FIG. 3). Similarly, axial movement of the mandrel and setting sleeve 2 such that the setting sleeve 2 is extended away from the lower end of the mandrel 3 will have the effect or releasing the force causing expansion of the packer 4 and slips 9 allowing them to contract. Such axial movement of the mandrel 3 and setting sleeve 2 can be provided by means of a setting tool of the type shown in FIG. 7, which engages the top connection 1 (for example, by means of the internal groove 1*b* in the upper end of the connection 1) and setting sleeve 2. The setting tool can pull on the mandrel 3 while holding the setting sleeve 2 to contract the mechanism.

A locking mechanism is provided around the upper part of the mandrel 3 to hold the mandrel 3 and setting sleeve 2 in the contracted configuration, once set (see FIG. 3). The locking mechanism comprises a ratchet tube 7 over which the setting sleeve 2 moves. The setting sleeve 2 has a ratchet ring 19 on its inner surface which engages the outer surface of the ratchet tube 7. The ratchet tube 7 is connected around the mandrel 3 together with a lock tube 8 and locking dogs 14 which engage in slots in the mandrel 3 and lock tube 8. A release sleeve 15 is positioned around the upper part of the mandrel 3, extending inside the setting sleeve 2 and around the lock tube 8 so as to prevent the locking dogs 14 from moving out of the slots in the mandrel 3 and disconnecting the mandrel 3 from the setting sleeve 2.

A fishing neck 17 is positioned around the top connection 1 above the release sleeve 15, to which it is connected by means of a shear screw. The shear screw and the locking dogs 14 prevent the release sleeve from moving during setting operations and when under differential pressure when the tool is set. Through ports are provided in the side wall of the fishing neck 17.

The tool can be deployed down hole by using deployment methods such as slick line, tractors, coiled tubing or drill pipe. A setting tool (with a setting adapter, see FIG. 7, that fits into the groove 1*b*) can be used to generate axial movement for installation. During installation in a well, the setting tool (not shown) generates a pulling force on the mandrel 3 and a pushing force on the setting sleeve 2 resulting in a movement of the mandrel 3 upwards after shearing a shear screw. The packer element 4 and the packer support 5, 6 are initially prevented from movement and expansion by shear screws 5*a* and 6*a*. The movement of the mandrel 3 relative to the setting sleeve 2, the packer 4 and packer supports 5, 6 will result the slips subs 10 and 11 being pushed towards each other. This movement results in the slips 9 being pushed radially outwards by the inclined surfaces on the slips 9 and slips subs 10 and 11. The external tube with slots 12 secures alignment of the slips 9 during expansion and prevents particles from entering enter the mechanism. When the outer surface of the slips 9 reaches the inner wall of the well (not shown), the mandrel 3 will be prevented from moving further upwards, and the setting sleeve 2 will start to move downwards. This will result in shearing of shear screws 5*a* and 6*a*, allowing the packer element 4 to be compressed and start to expand radially, and the packer supports 5, 6 on each side of the packer 4 to move radially towards the tubing inner wall. The shear screw 6*a* can be calibrated to shear at a lower force than the shear screw 5*a* to avoid friction between the packer 2 and the well wall during the setting sequence. The packer supports 5 and 6 can assist in centralizing the packer element 2 and the top of the plug inside the tubing. The ratchet ring 19 moves over the ratchet tube 7 and prevents the setting sleeve 2 from moving backwards after the setting tool is released, thus maintaining the force on the slips 9 and packer 4 during operations in such a way that the tool does not move in the wellbore when exposed to differential pressures above and below the tool. The plug can withstand pressure build up from both sides. When the setting force has reached a predetermined level during the installation, a calibrated shear disc is sheared, resulting in a disconnection of the setting tool from the plug.

Springs 13 located between the bull nose 20 and lower slips sub 11 secures the packer and anchor modules are kept in compression against the ratchet locking mechanism after the setting tool has been released from the tool and during pressure reversals.

Fluid under the tool can enter the interior of the mandrel 3 through the holes in the bull nose 20. However, flow through the mandrel above the tool is normally blocked, ensuring pressure isolation above and below the tool. When the pressure under the tool increases relative to the pressure over the plug, the slips 9 prevent upward movement of the tool in the wellbore, as the lower slips sub 11 will push the slips radially towards the tubing or casing wall, increasing the anchoring force. The slips 9 are designed to avoid damaging the tubing wall. The packer element 4 will be prevented from movement or extrusion by the upper expanded packer support 5. The extrusion gap between the tool outer body and the well inner diameter is completely covered mechanically by the expanded packer supports 5 and 6. This allows for the use of sophisticated elastomeric material with excellent performance in sour environments such as FKM, EPDM, and FFKM. These materials often have poor mechanical properties but may be damaged should there otherwise be any extrusion gap between the plug outer body and the well, tubing or casing inner wall. The packer module is prevented from movement by the ratchet ring 19 and the locking dogs 14 that connect the sleeve 2, the ratchet tube 7, the lock tube 8 and the mandrel 3. During pressure from below the tool, the mandrel 3 is prevented from moving by the slips 9. The position of the fishing neck 17, which closes the ports on the top connection 1 prevents pressure from below the tool from leaking through the mandrel 3. The radial ports in the top connection 1 and seals ensure a completely pressure equalized fishing neck 17 during pressure reversals.

When the pressure over the tool increases relative to the pressure below the tool, the slips 9 will prevent downward movement of the plug in the wellbore, as the upper slips sub 10 will push the slips 9 radially towards the tubing or casing wall in a similar manner as described above.

Figure 4:
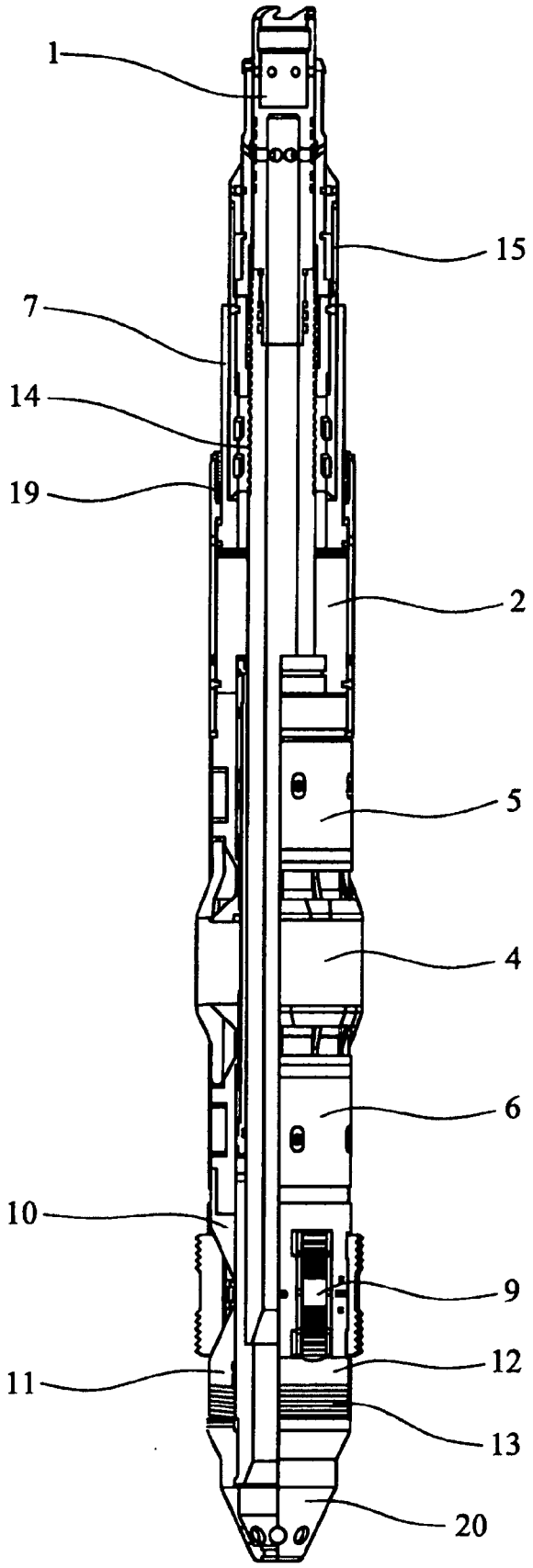
FIG. 4 shows the tool in an equalized configuration.

In order to aid in retrieval of the tool, the pressure above and below the tool can be equalized. The main method of equalizing by latching a pulling tool (not shown) on to the external fishing neck 17. The fishing neck 17 has external neck to which the pulling tool can be secured, even if debris or sand is present on top of the mandrel top connector 1. The length of the fishing neck 17 may be elongated if major quantities of sand or debris are expected in the well, to enable latching on to the fishing neck 17 without having to run bailers or to circulate fluid to clear the debris. The fishing neck 17 slides freely axially on the top connection 1 to stop particles entering between them. A shear screw prevents movement of the fishing neck 17 before the pulling tool is fully engaged. By jarring down with a relatively low force, the fishing neck 17 is moved downwards relative to the mandrel top connector 1. This axial movement will cause the equalizing ports in the mandrel top connector 1 to be aligned with the ports in the fishing neck 17 (see FIG. 4). When the holes are aligned, differential pressure on either side of the tool can be equalized. The pressure drop and flow may be restricted by using nozzles in the ports in the mandrel top connector 1 so as to control the effect of rapid explosive decompression in the packer 4 and seals. This effect can otherwise damage the elastomer, as gas that has migrated into the elastomer at high pressure, can otherwise expand inside the elastomer when the external pressure drops rapidly and un-controlled, and may result in retrieving problems.

If pressure equalization is not possible using the method described above, a backup method can be provided. The top connection 1 has grooves 1*b* that can be used for creating torque from an external equalizing tool (not shown). By rotating the top connection 1 in a predetermined direction (e.g. anticlockwise), the top connection 1 will be moved up relative to the mandrel 3 by a screw action causing the seals between the mandrel 3 and the top connection 1 to be disengaged. A radial hole in the top connection 1 allows pressure to bleed off below the top connection 1 without disengaging the threads connecting the top connection 1 and the mandrel 3. The top connection 1 is made with a relatively thin wall to withstand the differential pressures towards the mandrel 3. Although designed for holding high differential pressures, the wall can also be punctured by using a jar and a puncturing tool. The wall may also be replaced by a separate sealed disc with a material such as glass, should a puncturing equalizing method be preferred. This operation will not result in the release of slips 9 from the tubing wall during equalization.

Finally, by using a drill deployed separately by coiled tubing, wire line tractor or drill pipe, equalizing of the tool can be achieved by drilling through the mandrel top connection 1. By drilling such a hole, the pressure differential across the tool can be equalized. This operation also will not result in the release of slips 9 from the tubing wall during equalization.

Figure 5:
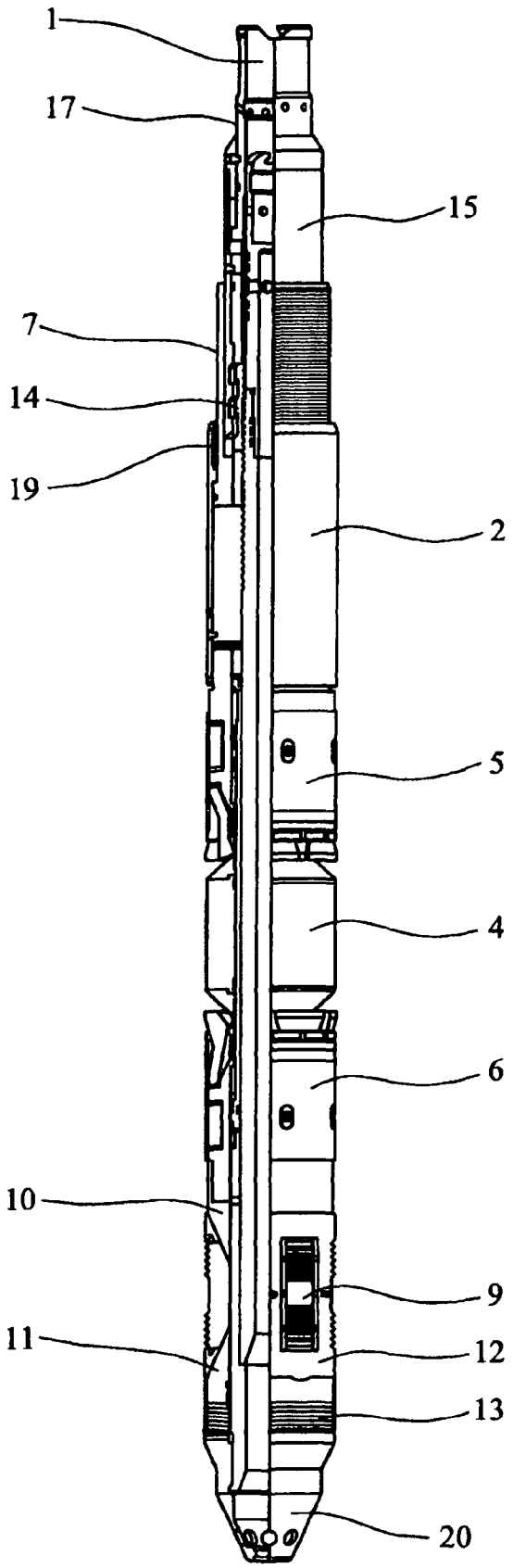
FIG. 5 shows the tool in a released configuration.
Figure 6:
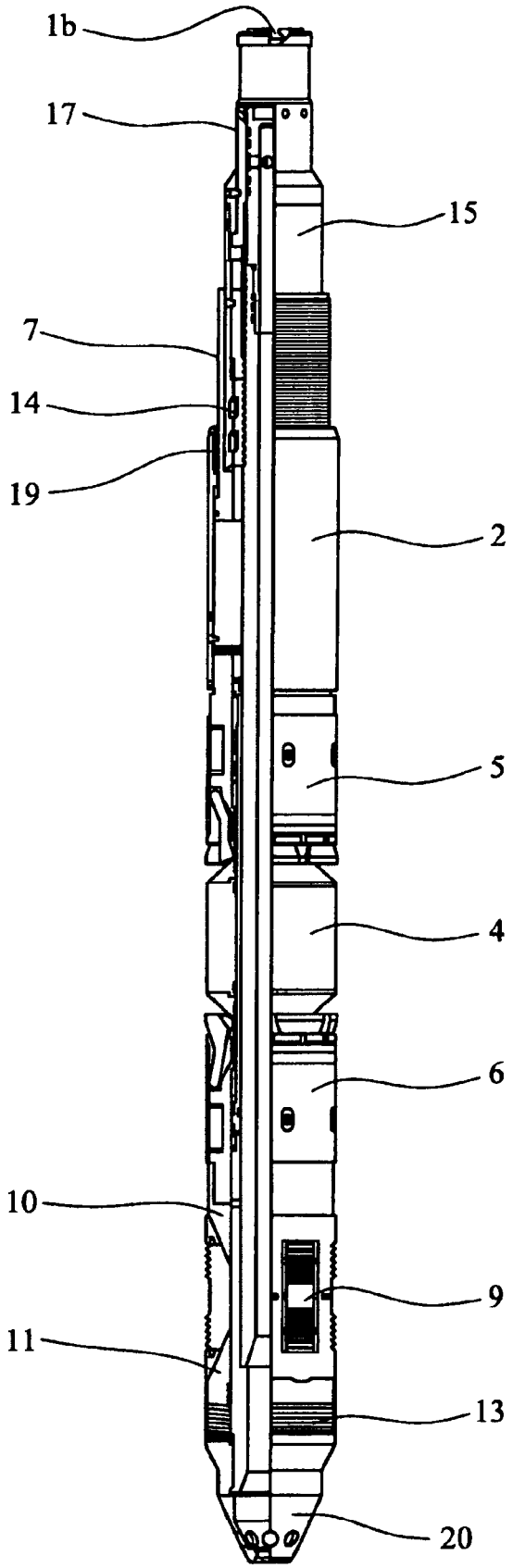
FIG. 6 shows the tool in an alternative released configuration.

Once pressure has been equalized, the tool can be released and retrieved. When the fishing neck 17 is pulled upwards relative to the mandrel 3, the release sleeve 15 is also pulled up, allowing the locking dogs 14 to move radially away from the mandrel 3. The profile of the connection between the locking dogs 14 and mandrel 3 forces the locking dogs 14 to move away from the mandrel 3 and thereby release the mandrel 3 from locking tube 8. This releases the compression in the plug, and causes the mandrel 3 to move down relative to the setting sleeve 2 due to gravity. The slips 9 have an outer chamfer that forces the slips radially inwards by the now released weight of the mandrel 3 and bull nose 20. Jarring upwards on the fishing neck 17 will also assist in the contraction of packer 4, packer support 5, 6 and slips 9 (see FIG. 5). The mandrel 3 has grooves extending from the initial location of the locking dogs up to the top connection 1. Should there be a need to push the tool downward into the well, the locking dogs 14 will reengage into the grooves near the top connection 1. This will ensure that the slips 9, packer support 5, 6 and packer 4 cannot be reset down hole after having been released.

Should it not be possible to move the release sleeve 15 upwards by pulling the system, a backup release method can be provided. By rotation of the mandrel 3 relative to the locking dogs 14, the mandrel 3 can be elongated, resulting in the reduction and removal of the compression force used to set the packer 4, packer supports 5, 6 and slips 9. This function is obtained through a threaded connection between the mandrel 3 and the mandrel extension 3*b* at the lower end of the mandrel. The top connection 1 and the fishing neck 17 have slots where a release tool (not shown) can be installed. The release tool can generate a torque on the mandrel, while at the same time preventing the locking dogs 14 from rotating. The connection between the release sleeve 15 and the lock tube 8 allows an external torque to be applied on the mandrel 3. The mandrel extension 3*b* is prevented from rotation by slots in the upper and lower slips subs 10, 11. By applying a torque on the mandrel 3, the mandrel extension 3*b* will therefore move axially downwards relative to the locking dogs 14. This axial movement will remove the compression on the plug by pulling down the lower slips sub 11. Should the tool continue to be stuck, a downward jarring on top of the mandrel 3 results in shearing a weak point the tension ring 21. At this stage, the mandrel can be pushed downwards and dropped. A catcher mechanism can be installed in the upper slips sub 10 to prevent the mandrel 3 from falling to the bottom of the well. The primary and secondary release can be done on slick line, coil tubing, well tractor etc. The top of the plug is however made in such a way that milling to release the ratchet system or the mandrel can be done with limited milling distances.

During retrieval, the packer 4 and slips 9 are contracted by the weight of the mandrel 3, top connection 1 and bull nose 20, which serve to pull the mandrel down under the effect of gravity. The packer 4 is mechanically connected to the packer support 5 in such a way that should the packer 4 meet a restriction on the way out of the hole, an increased puling force created by slick line, coiled tubing or well tractor, will result in a mechanical pulling directly on the upper side of the elastomeric packer element 4 rather than expanding the packer and re-setting the tool.

Further changes can be made within the scope of the invention.

The invention claimed is:

1. A bridge plug tool for use in a well, comprising:

a tool body;

a mandrel extending through the tool body;

a setting sleeve positioned on the tool body;

a packer module located below the setting sleeve, the packer module having an expanded position in which its outer surface is expanded radially with respect to the tool body and a contracted position in which its outer surface is substantially the same as that of the tool body; and an anchor module located below the packer module, the anchoring module comprising anchor elements moveable between an expanded position in which the anchor elements extend radially from the tool body and a contracted position in which the anchor elements are substantially aligned with the surface of the tool body;

wherein the mandrel extends through the sleeve, packer module and anchor module; the mandrel and setting sleeve are relatively moveable between an axially extended position and an axially contracted position; and wherein the mandrel and setting sleeve engage the anchor module and packer module such that relative movement of the mandrel and setting sleeve between the axially extended and axially contracted positions correspondingly moves the anchor module and packer module between the respective contracted and expanded positions; and wherein the mandrel comprises a main part and an extension part connected by means of a threaded engagement, wherein the extension part engages the tool body such that rotation of the main part extends the extension part by the action of the thread so as to provide relative movement of the mandrel and the sleeve to the extended position;

the tool further comprising a locking mechanism for holding the setting sleeve and mandrel in the contracted position, wherein the locking mechanism comprises:

a ratchet sleeve surrounding the mandrel which extends within and engages the setting sleeve; and locking dogs located within the ratchet sleeve which engage the mandrel; and a release mechanism for releasing the mandrel and sleeve from the contracted position, wherein the release mechanism comprises a release sleeve which extends within the ratchet sleeve and is axially moveable to allow the locking dogs to disengage from the mandrel.

2. A tool as claimed in claim 1, wherein the anchor elements comprise a series of slips arranged around the tool body that in use engage the wall of the well when in the extended position to prevent further movement of the tool in the well.

3. A tool as claimed in claim 2, wherein the anchor module comprises actuators that are mounted on the tool body to be axially moveable relative thereto by means of the mandrel and setting sleeve, the actuators comprising inclined surfaces that engage corresponding surfaces on the slips and force them radially outwards when the mandrel and setting sleeve are contracted.

4. A tool as claimed in claim 3, wherein the actuators comprise upper and lower subs mounted around the tool body above and below the slips.

5. A tool as claimed in claim 1, wherein the packer module comprises a packer and upper and lower packer supports, the packer supports being mounted around the tool body and engaged with the mandrel and sleeve such that contraction of the mandrel and packer acts to expand the packer.

6. A tool as claimed in claim 1, wherein the mandrel provides a fluid flow path with an opening at the bottom of the tool body, the tool further comprising a connection at the top of the mandrel surrounded by a fishing neck above the setting sleeve, wherein the connection and the fishing neck each have one or more ports and are relatively moveable so that the ports can be brought into alignment to allow fluid communication though the mandrel to the exterior of the tool body above the packer module.

7. A tool as claimed in claim 6, wherein the fishing neck is axially or rotationally moveable to bring the through holes into alignment.

8. A tool as claimed in claim 1, further comprising a portion of the wall of the tool body that can be broken to allow fluid communication between the interior and exterior of the tool body.

9. A method of operating a tool as claimed in claim 1, comprising:

positioning the tool in a well at a predetermined location with the mandrel and setting sleeve in the extended position and the anchor and packer modules in contracted positions;

initially contracting the mandrel and setting sleeve to expand the anchor module to engage the wall of the well and anchor the tool in position;

further contracting the mandrel and setting sleeve by movement of the setting sleeve over the mandrel to expand the packer module to seal against the wall of the well; and securing the mandrel and setting sleeve in the further contracted position.

10. A method as claimed in claim 9, further comprising opening one or more ports above the packer to allow fluid communication through the tool across the packer so as to equalize any pressure difference.

11. A method as claimed in claim 10, wherein the opening of the one or more ports is achieved by relative axial or rotational movement of a fishing neck and connection located at the top of the tool.

12. A method as claimed in claim 10, wherein the opening of the one or more ports is achieved by breaking or perforating a portion of the wall of the tool body.

13. A method as claimed in claim 9, further comprising:

moving the setting sleeve and mandrel to the extended position to move the packer module and anchor module to their respective contracted positions to disengage the anchor module from the wall of the well and release the seal of the packer module against the wall of the well.

14. A method as claimed in claim 13, wherein moving the setting sleeve and mandrel comprises releasing the setting sleeve from the mandrel.

15. A method as claimed in claim 13, wherein moving the setting sleeve and mandrel comprises rotating the mandrel to operate a screw thread to extend a portion of the mandrel relative to the setting sleeve.

* * * * *